US007913833B2

(12) United States Patent
Sperl et al.

(10) Patent No.: US 7,913,833 B2
(45) Date of Patent: Mar. 29, 2011

(54) DEVICE FOR ALIGNING DISORDERED SHEET-TYPE PRODUCTS

(75) Inventors: Markus Sperl, Garching (DE); Michael Stapfer, Neubiberg (DE)

(73) Assignee: Giesecke & Devrient GmbH, Munich (DE)

( * ) Notice: Subject to any disclaimer, the term of this patent is extended or adjusted under 35 U.S.C. 154(b) by 305 days.

(21) Appl. No.: 11/886,967

(22) PCT Filed: Mar. 23, 2006

(86) PCT No.: PCT/EP2006/002681

§ 371 (c)(1),
(2), (4) Date: May 1, 2008

(87) PCT Pub. No.: WO2006/100079

PCT Pub. Date: Sep. 28, 2006

(65) Prior Publication Data

US 2009/0035118 A1 Feb. 5, 2009

(30) Foreign Application Priority Data

Mar. 24, 2005 (DE) ..... 10 2005 014 290

(51) Int. Cl.

| | |
|---|---|
| ***B65G 47/24*** | (2006.01) |
| ***B65G 47/44*** | (2006.01) |
| ***B65G 47/00*** | (2006.01) |
| ***B65G 47/18*** | (2006.01) |
| ***B65G 47/04*** | (2006.01) |

(52) U.S. Cl. ..... 198/383; 198/389; 198/396; 198/406; 198/416; 198/525; 198/540

(58) Field of Classification Search ..... 198/383, 198/389, 396, 406, 416, 525, 540
See application file for complete search history.

(56) References Cited

U.S. PATENT DOCUMENTS

| | | | | |
|---|---|---|---|---|
| 1,130,756 | A * | 3/1915 | Nash | 210/465 |
| 2,905,309 | A | 9/1959 | Makrides | |
| 4,909,499 | A * | 3/1990 | O'Brien et al. | 271/10.06 |
| 7,165,053 | B2 * | 1/2007 | Beck | 705/401 |
| 2007/0272730 | A1 * | 11/2007 | Christl et al. | 232/1 D |

FOREIGN PATENT DOCUMENTS

| | | | |
|---|---|---|---|
| DE | 1 130 756 | B | 5/1962 |
| DE | 1130756 | B * | 5/1962 |
| DE | 1 944 180 | | 10/1970 |
| DE | 698 23 060 | T2 | 1/1999 |
| DE | 10 2004 003 289 | A1 | 8/2004 |
| FR | 2831530 | | 5/2003 |
| FR | 2831530 | A1 * | 5/2003 |

OTHER PUBLICATIONS

Search Report of German PTO regarding German Patent Application No. 10 2005 014 290 7, Oct. 12, 2005.

* cited by examiner

*Primary Examiner* — Gene Crawford
*Assistant Examiner* — Yolanda Cumbess
(74) *Attorney, Agent, or Firm* — Bacon & Thomas, PLLC

(57) ABSTRACT

The invention relates to an apparatus for aligning disordered sheet material.
The apparatus according to the invention in particular has the advantage, that disordered sheet material is fast and reliably aligned, so that the sheet material can be formed into bundles. Since the alignment of the sheet material can be carried out automatically by the apparatus, i.e. in particular has not to be carried out by an operator, moreover, a cost-effective alignment of the disordered sheet material is permitted.

12 Claims, 3 Drawing Sheets

DEVICE FOR ALIGNING DISORDERED SHEET-TYPE PRODUCTS

FIELD OF THE INVENTION

The invention relates to an apparatus for aligning disordered sheet material.

BACKGROUND

Sheet material is often provided in a disordered, not aligned form. For example, when paying in bank notes, larger quantities of bank notes are collected in cassettes, the bank notes not being put together to bundles that are aligned along edges of the bank notes. Such cassettes are referred to as free-fall cassettes. The bank notes are put into the cassette, for example, through an input opening, without depositing the bank notes in the cassette being guided in any fashion. The result is a disordered pile of bank notes, the bank notes not having any alignment to each other.

It is known to remove disordered piles of bank notes, as they are occurring for example in free-fall cassettes, from the free-fall cassettes, to align them manually along edges of the bank notes, and to form bundles. The bank notes provided in the form of bundles then, for example, can be processed with bank note processing machines, e.g. in order to be able to sort the bank notes according to currency, denomination, state etc.

But when the alignment for bundling up the bank notes provided as a disordered pile is carried out in a known fashion, this has the disadvantage that it is extremely labor-intensive and time-consuming. In addition, high costs for the processing required for aligning the disordered bank notes arise thereby.

Therefore, it is the problem of the present invention to provide an apparatus for aligning disordered sheet material, which aligns the disordered sheet material fast, reliable and cost-effective, so that the sheet material can be formed into bundles.

SUMMARY OF THE INVENTION

The apparatus according to the invention for aligning disordered sheet material, in particular bank notes, has an opening for inputting disordered sheet material, a diverting element adjacent to the opening that diverts the disordered sheet material in the direction of one of the long edges of the sheet material, and a guiding element that aligns the disordered sheet material along the long edges of the sheet material.

The apparatus according to the invention in particular has the advantage, that disordered sheet material is aligned fast and reliable, so that the sheet material can be formed into bundles. Since the alignment of the sheet material can be carried out automatically by the apparatus, i.e. in particular has not to be carried out by an operator, moreover, a cost-effective alignment of the disordered sheet material is permitted.

BRIEF DESCRIPTION OF THE DRAWINGS

Further advantages of the present invention appear from the dependent claims and the following description of embodiments with reference to Figures.

DETAILED DESCRIPTION OF THE PREFERRED EMBODIMENTS

Figure 1:
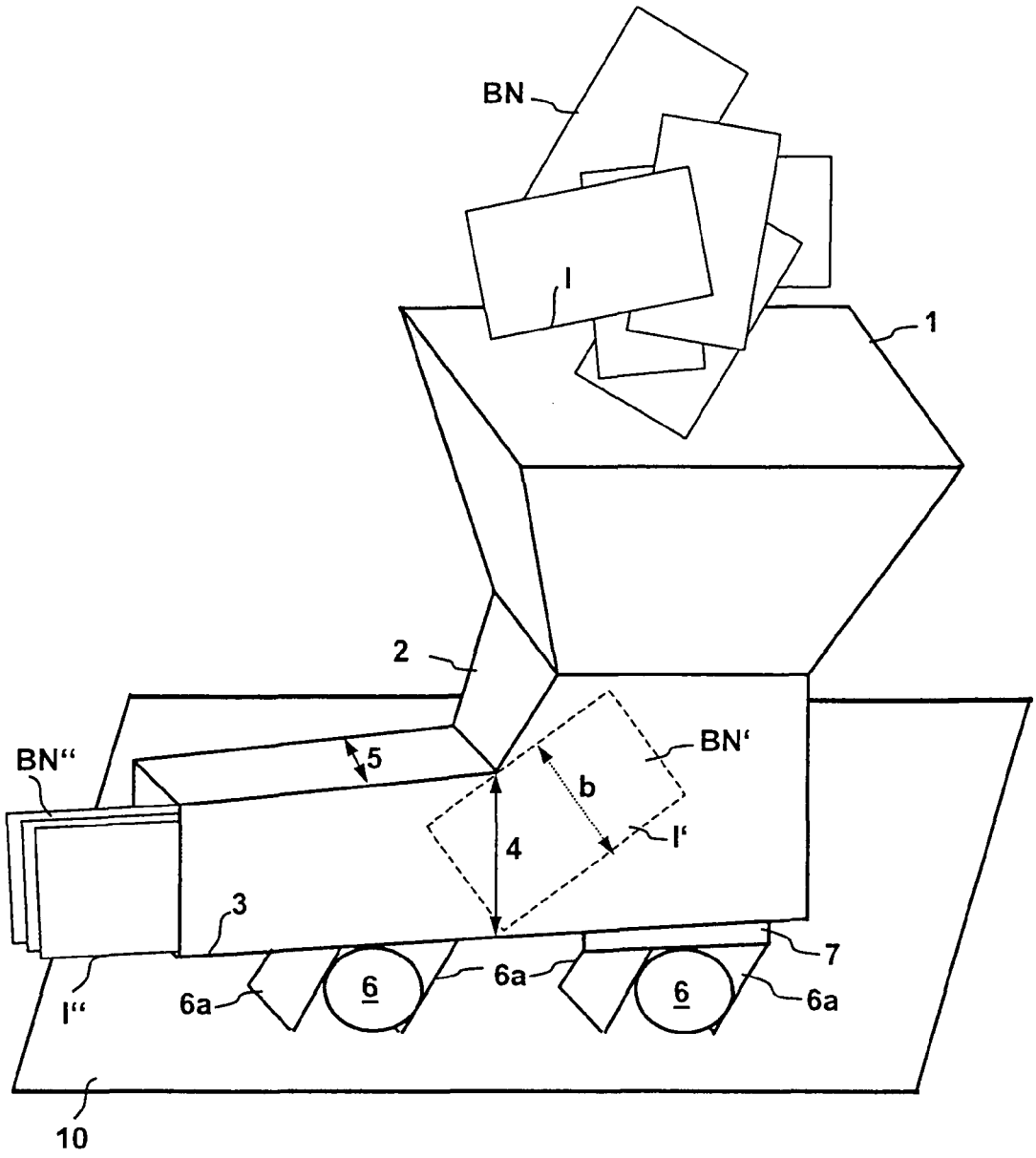
FIG. 1 shows a basic structure of a first embodiment of an apparatus for aligning disordered sheet material.
Figure 2:
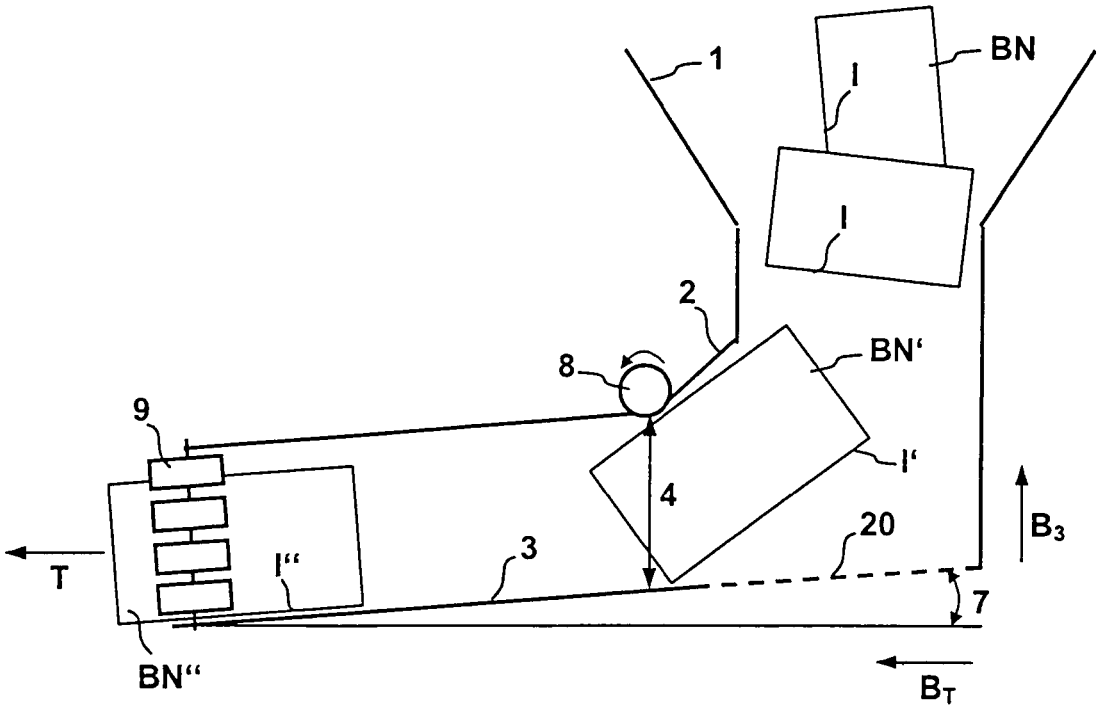
FIG. 2 shows a longitudinal section through the apparatus for aligning disordered sheet material as shown in FIG. 1.
Figure 3:
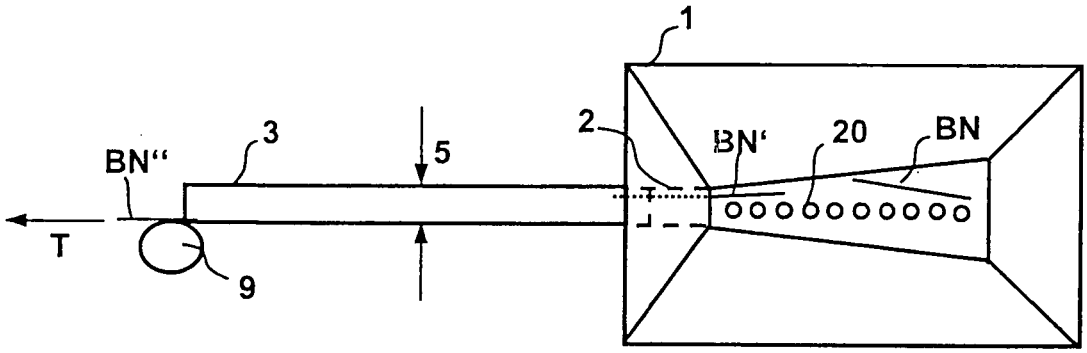
FIG. 3 shows a view from above into the apparatus for aligning disordered sheet material as shown in FIG. 1.

FIG. 1 shows a schematic representation of a basic structure of a first embodiment of an apparatus for aligning disordered sheet material, in particular bank notes. FIG. 2 shows a longitudinal section through this apparatus, whereas FIG. 3 shows a view from above into the apparatus.

Disordered bank notes BN are put into an opening 1 of the apparatus for aligning. Elements 2, 3 connected to opening 1 effect that the bank notes BN' are diverted in the direction of one of the long edges 1' of the bank notes BN' and the alignment of the bank notes BN" along the long edges 1'. The such aligned bank notes BN" can be removed from the apparatus for aligning, e.g. in order to bundle them.

Opening 1 advantageously is formed as a rectangular funnel and it has a cross section that in particular is greater than the greatest bank note to be processed. After opening 1 the cross section becomes smaller and leads bank notes BN' to be aligned to a guiding element 3. A diverting element 2 effects that bank notes BN' are diverted such that one of their longitudinal edges is aligned in parallel to guiding element 3 and one of the longitudinal edges 1' touches guiding element 3.

In order to support the effect of diverting element 2, for diverting bank note BN' a roller 8 can be provided, the surface of which preferably has a high coefficient of friction. The roller is driven against transport direction T, so that it supports the diversion of the bank notes BN'. The high coefficient of friction can be achieved by a silicone.

Guiding element 3 has at least a height 4, which corresponds to the width b of the greatest bank note BN' to be processed. Additionally, guiding element 3 has a width 5, which is smaller than the width of the smallest bank note to be processed. In this way it can be ensured, that bank notes BN' can only arrive in guiding element 3 in a fashion standing on one of their longitudinal edges 1' and are transported along guiding element 3 in a transport direction T, as a result of which the desired alignment is accomplished.

In order to transport the bank notes BN' in the predetermined transport direction T, it can be provided that guiding element 3 has an inclination 7, so that bank notes BN" are transported to the output of the apparatus for aligning.

In addition to inclination 7 or instead of inclination 7 a device 6 can be provided, which sets the apparatus in motion, in particular vibration. The motion has two parts $B_G$ and $B_T$. Motion part $B_G$ is directed against the gravitation, whereas motion part $B_T$ is directed towards the direction of transport direction T. By motion part $B_G$ it is achieved that the disordered bank notes BN input into opening 1 and transported by gravitation in the direction of guiding element 3 are loosen up, so that it is reliably achieved that one of the longitudinal edges 1 of each of the bank notes BN is in contact with guiding element 3, in order to ensure the desired alignment. Motion part $B_T$ effects the transport of the bank notes in transport direction T, in the direction towards the output of the apparatus for aligning.

In order to avoid a not desired transport of the bank notes against transport direction T, it can be provided that the surface, or partial areas of the surface, of guiding element 3 has a structure, which prevents a transport against transport direction T. For this purpose, for example, a scale- or pelt-like structure can be provided, which is disposed such that the scales or the hair of the pelt are directed against the not desired transport direction.

The motion with the motion parts $B_G$ and $B_T$ can be produced by one or a plurality of throw vibrators 6. Throw vibrator 6 is formed by a coil 6 through which flows alternating current and which produces a vibration of a certain frequency, that is connected with the apparatus for aligning by one or a plurality of springs 6*a*. Throw vibrators 6 are fastened on a firm base 10, e.g. a heavy cast iron frame. Advantageously, the frequency of the vibration is selected such that it corresponds to the natural frequency of the apparatus for aligning. This can be achieved by using alternating current of a corresponding frequency.

Instead of throw vibrators 6 a motor with an eccentric can be used, which produces the described parts of the motion $B_G$ and $B_T$.

Figure 4:
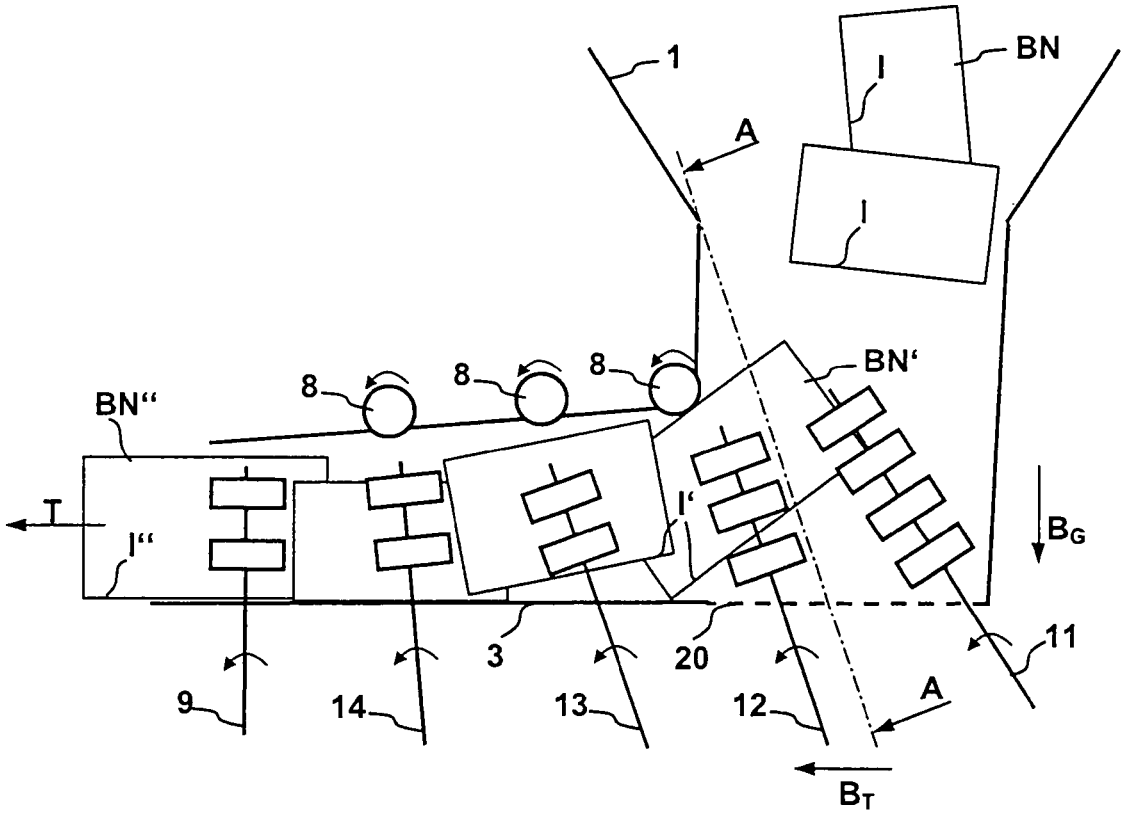
FIG. 4 shows a longitudinal section through a basic structure of a second embodiment of an apparatus for aligning disordered sheet material.
Figure 5:
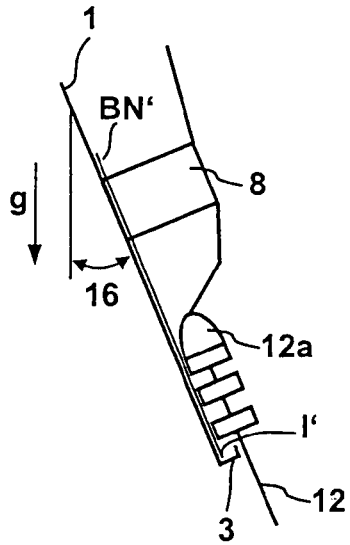
FIG. 5 shows a view into the apparatus for aligning disordered sheet material as shown in FIG. 4, along an intersecting line AA.

FIG. 4 shows a schematic representation of a longitudinal section through a basic structure of a second embodiment of an apparatus for aligning disordered sheet material, in particular bank notes. FIG. 5 shows a view into the apparatus for aligning disordered sheet material as shown in FIG. 4, along an intersecting line AA.

The second embodiment of the apparatus for aligning disordered sheet material has a similar structure as the above-described first embodiment, with an opening 1, diverting elements 8, and a guiding element 3. But the transport in transport direction T and the alignment of the bank notes at the guiding element 3 is effected by rollers or rolls 11 to 14 driven in transport direction T. Rollers 11 to 14, preferably, have a surface of high friction, e.g. a friction as such of silicone. Rollers 11 to 14 are disposed such that the first rollers 11, 12 have a greater motion part $B_3$ in the direction of guiding element 3, whereas the following rollers 13, 14 have a greater motion part $B_T$ in the direction of transport direction T.

As it can be recognized in FIG. 5, the apparatus for aligning disordered bank notes preferably is installed with an inclination 16, so that the bank notes are pushed by gravitation g against the apparatus for aligning 1, so that rollers 12 can seize them. In order to avoid jam, the rollers 12 can have transitions 12*a*, e.g. bevel gears, which prevent that too much bank notes are seized, which would cause a jam.

At the output of the above-described embodiments of the apparatuses for aligning there are one or a plurality of aligned bank notes BN", which are aligned at one of their longitudinal edges 1". The aligned bank notes BN" finally can be removed at the output of the apparatus for aligning, e.g. as to form a bundle of bank notes.

At the output of the apparatus can be mounted a not shown collecting receptacle, in which the aligned bank notes BN" are collected, so that they can be removed as bundles from the collecting receptacle.

Likewise, it is possible to mount a singler 9 at the output of the apparatus, which can separately transfer the aligned bank notes BN" to a not shown transport system that feeds the individual bank notes BN" into a processing system. This can be a bank note processing machine, in which the bank notes are checked, e.g. as to currency, denomination, state etc, and are sorted dependent on the result of such check. Likewise, it is possible to feed the individual bank notes to a stacking apparatus, e.g. a spiral slot stacker, which forms an ordered bundle of bank notes or stacks the bank notes in a cassette in an ordered fashion.

The apparatus for aligning can be made of metal and/or plastic, e.g. of sheet metal.

Since loose soil often sticks to the bank notes that are to be processed by the apparatus for aligning, a device for removing soil can be provided. The device for removing soil removes soil particles, which loosen from the bank notes during the processing in the apparatus for aligning. Preferably, the device for removing soil is disposed in the area of the funnel-shaped opening 1. For this purpose, for example perforations 20 are provided in guiding element 3, which have a size such that the soil particles can pass through. But the perforations are so small that the bank notes to be processed cannot get caught therein. To perforations 20, in addition, a not shown device for creating low pressure can be connected, in order to suck out the soil particles. The perforations 20, deviating from the representation, can also extend along the entire guiding element 3 or can be disposed at other positions of the apparatus for aligning.

The invention claimed is:

1. An apparatus for aligning disordered sheet material having opposed pairs of longer and shorter edges, such as bank notes, comprising an opening for inputting disordered sheet material, a diverting element adjacent to the opening, arranged to divert the disordered sheet material in the direction of one long edge of the sheet material, and a guiding element, arranged to align the disordered sheet material along the long edges of the sheet material, wherein the guiding element has a height, which is at least the width of the largest piece of sheet material to be aligned, and wherein the guiding element has a width which is smaller than the width of the smallest piece of sheet material to be aligned, wherein the width of the sheet material to be aligned is the distance between the opposed longer edges.

2. The apparatus according to claim 1, including a moving device that produces a motion with two motion parts, which is transmitted to the sheet material to be aligned, so that the sheet material is moved against the guiding element and is aligned along the guiding element.

3. The apparatus according to claim 2, wherein the moving device is connected with the apparatus for aligning and moves it, wherein the moving device comprises at least one throw vibrator or a motor with eccentric.

4. The apparatus according to claim 2, wherein the moving device moves the sheet material to be aligned, and comprises rollers.

5. The apparatus according to claim 1, wherein the inner surface of the apparatus for aligning at least partially comprises a structure, which prevents the motion of the sheet material in a predetermined direction.

6. The apparatus according to claim 1, wherein at the output of the apparatus for aligning a collecting receptacle is mounted in order to collect and bundle the aligned sheet material.

7. The apparatus according to claim 1, wherein at the output of the apparatus for aligning a singler is mounted, said singler arranged to single pieces of the aligned sheet material.

8. The apparatus according to claim 7, including a transport system mounted at the singler, and which is arranged to transport the singled pieces of sheet material.

9. The apparatus according to claim 8, wherein the transport system is part of a bank note processing machine.

10. The apparatus according to claim 8 including a collecting receptacle, and wherein the transport system is arranged to transport the singled sheet material into the collecting receptacle, in order to collect and bundle the sheet material.

11. The apparatus according to claim 8, wherein the transport system is arranged to transport the singled sheet material into a cassette, in order to collect and bundle the sheet material.

12. The apparatus according to claim 1, including apparatus for removing soil.

* * * * *